US008135301B2

(12) United States Patent
Fujimori et al.

(10) Patent No.: US 8,135,301 B2
(45) Date of Patent: Mar. 13, 2012

(54) DEVELOPING DEVICE AND IMAGE FORMING APPARATUS

(75) Inventors: Shinichiro Fujimori, Kanagawa (JP); Yoshifumi Ozaki, Kanagawa (JP); Takashi Ochi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 371 days.

(21) Appl. No.: 12/478,321

(22) Filed: Jun. 4, 2009

(65) Prior Publication Data

US 2010/0150616 A1 Jun. 17, 2010

(30) Foreign Application Priority Data

Dec. 15, 2008 (JP) ..... P2008-318511

(51) Int. Cl.
*G03G 15/08* (2006.01)

(52) U.S. Cl. ..... 399/92; 399/98; 399/269

(58) Field of Classification Search ..... 399/279, 399/265, 267, 269, 98, 92
See application file for complete search history.

(56) References Cited

U.S. PATENT DOCUMENTS

| | | | | |
|---|---|---|---|---|
| 4,361,396 | A * | 11/1982 | Uchida | 399/92 |
| 7,043,172 | B2 * | 5/2006 | Koshimura et al. | 399/92 X |
| 7,991,318 | B2 * | 8/2011 | Tamura et al. | 399/92 |
| 2002/0127488 | A1 * | 9/2002 | Suzuki et al. | 399/269 X |
| 2005/0111874 | A1 * | 5/2005 | Kim et al. | 399/98 |
| 2006/0239710 | A1 | 10/2006 | Kumar et al. | 399/103 |
| 2007/0059025 | A1 * | 3/2007 | Lee | 399/98 |

FOREIGN PATENT DOCUMENTS

| | | | | |
|---|---|---|---|---|
| JP | 05-011594 | | | 1/1993 |
| JP | 07-036264 | | | 2/1995 |
| JP | 2003-295714 | | | 10/2003 |
| JP | 2004-177452 | | | 6/2004 |
| JP | 2006-106557 | A | * | 4/2006 |
| JP | 2006-309240 | | | 11/2006 |
| JP | 2007-086436 | A | * | 4/2007 |
| JP | 2007-310188 | A | * | 11/2007 |
| JP | 2008-170738 | A | * | 7/2008 |

* cited by examiner

*Primary Examiner* — Sophia S Chen
(74) *Attorney, Agent, or Firm* — Morgan, Lewis & Bockius LLP

(57) ABSTRACT

A developing device includes a developer transporting member arranged so that its circumferential surface faces an image carrier for carrying an electrostatic image on its surface, the developer transporting member being rotated in a circumferential direction while carrying the developer on its circumferential surface to transport a developer to a developing region in which the surface of the image carrier and the circumferential surface of the developer transporting member face each other, and having a groove extending in its circumferential direction outside in an axial direction of a developer carrying region; and a suction port arranged at least at one of an upstream side region and a downstream side region of the developer transporting member, wherein the upstream side region is located adjacent to and upstream of the developing region and the downstream side region is located adjacent to and downstream of the developing region in the rotating direction of the developer transporting member.

9 Claims, 8 Drawing Sheets

DEVELOPING DEVICE AND IMAGE FORMING APPARATUS

CROSS-REFERENCE TO RELATED APPLICATION

This application is based on and claims priority under 35 USC 119 from Japanese Patent Application No. 2008-318511 filed Dec. 15, 2008.

BACKGROUND

Technical Field

The present invention relates to a developing device and an image forming apparatus.

SUMMARY

According to an aspect of the invention, a developing device includes a developer transporting member that is arranged so that a circumferential surface of the developer transporting member is opposed to an image carrier for carrying an electrostatic image on a surface thereof, the developer transporting member being rotated in a circumferential direction while carrying the developer on the circumferential surface thereof to transport a developer to a developing region in which the surface of the image carrier and the circumferential surface of the developer transporting member are opposed to each other, and having a groove extending in the circumferential direction on the circumferential surface of the developer transporting member outside in an axial direction of a developer carrying region for carrying the developer, and a suction port being arranged at least at one of an upstream side region and a downstream side region of the developer transporting member, wherein the upstream side region is located adjacent to and upstream of the developing region in the rotating direction of the developer transporting member, and the downstream side region is located adjacent to and downstream of the developing region in the rotating direction of the developer transporting member.

BRIEF DESCRIPTION OF THE DRAWINGS

Exemplary embodiments of the invention will be described in detail based on the following figures, wherein.

DETAILED DESCRIPTION

Figure 1:
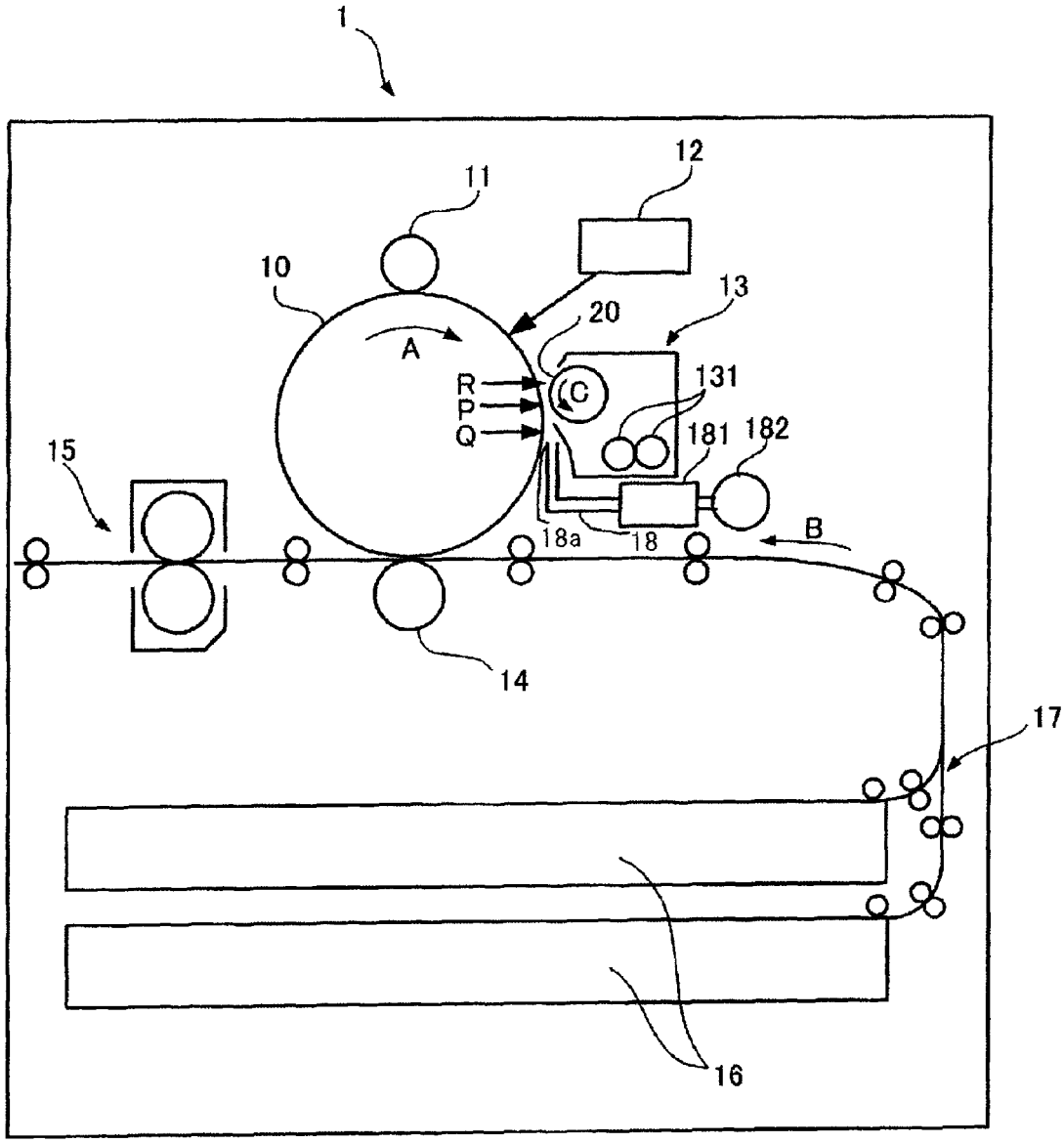
FIG. 1 is an arrangement view showing an outline of a printer which is an exemplary embodiment of an image forming apparatus of the present invention.

Referring to the drawings, an exemplary embodiment of the present invention will be explained below.

Figure 2:
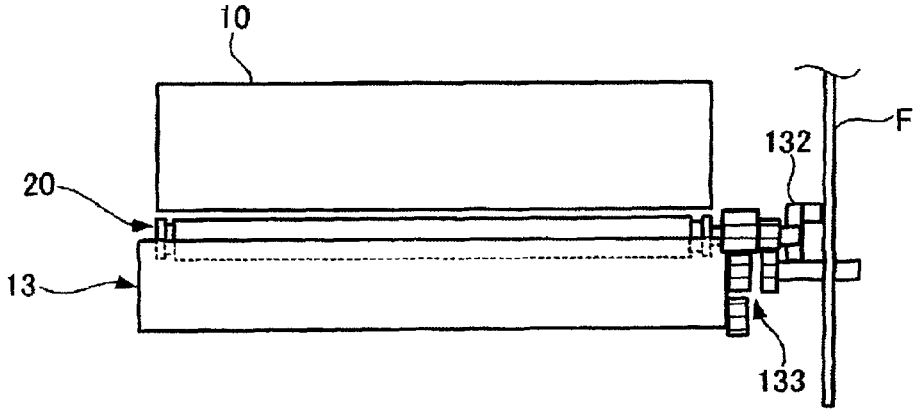
FIG. 2 is a plan view showing an arrangement of a photoreceptor and a developing unit of the printer shown in FIG. 1.

FIG. 1 is an arrangement view showing an outline of a printer which is an exemplary embodiment of an image forming apparatus of the present invention. FIG. 2 is a plan view showing an arrangement in the periphery of a developing device of the printer.

The printer 1 shown in FIG. 1 includes: a photoreceptor 10; a charging unit 11 for giving an electric charge onto a surface of the photoreceptor 10; an exposing unit 12 for forming an electrostatic image on the photoreceptor 10 by irradiating the photoreceptor 10 with exposure light, which corresponds to image data; a developing unit 13 for developing the electrostatic image carried on the photoreceptor 10 by the developer containing toner; a sheet cassette 16 for accommodating sheets of recording paper; a sheet transport unit 17 for drawing out the sheets of recording paper from the sheet cassette 16 and transporting them; a transfer unit 14 for transferring the toner image formed on the photoreceptor 10 onto the sheet of recording paper; a fixing unit 15 for fixing the toner image formed on the recording sheet by heating and pressurizing; and a suction tube 18 for sucking the floating toner, which is raised up in the air, together with the air.

The developing unit 13 includes: a developing roller 20 for transporting the developer toward the photoreceptor 10; and a stirring member 131 for stirring the developer. The stirring member 131 stirs the toner contained in the developer and the magnetic carrier, so that the toner and the magnetic carrier can be electrically charged to the opposite polarity and can be made to electrostatically adhere to each other and supplied to the developing roller 20. The developing roller 20 is arranged so that a circumferential surface of the developing roller 20 can be opposed to the photoreceptor 10. When the developing roller 20 carries the developer on its circumferential surface and rotates in the circumferential direction of this circumferential surface, the developer can be transported to the developing region P in which the surface of the photoreceptor 10 and the circumferential surface of the developing roller 20 are opposed to each other. The developing roller 20 in the present exemplary embodiment is rotated in the rotary direction C which is opposite to the rotary direction A of the photoreceptor 10. That is, a moving direction of the circumferential surface of the developing roller 20 in the portion, in which the developing roller 20 is opposed to the photoreceptor 10, is the same as the moving direction of the surface of the photoreceptor 10.

As shown in FIG. 2, outside the developing unit 13, in more detail, outside the developing roller 20 in the axial direction of the rotary central shaft of the developing roller 20, the feeding member 132 for supplying voltage to the developing roller 20 and the gear train 133 for driving the developing roller 20 and the stirring member 131 are arranged. The feeding member 132 and the gear train 133 are arranged between the frame F composing a housing of the printer and the developing unit 13.

Concerning the suction tube 18 shown in FIG. 1, the suction port 18*a* provided at one end portion of the suction tube 18 is arranged in the region Q on the downstream side of the rotation of the developing roller 20 which is located adjacent to the developing region P. The other end of the suction tube 18 is connected to the pump 182 through the filter 181. The suction tube 18 sucks air from the region Q on the downstream side of the developing region P through the suction port 18*a* by the action of the pump 182.

In this case, the developing unit 13 corresponds to the first exemplary embodiment of the developing device of the present invention. The developing roller 20 corresponds to an example of the developer transporting member for transporting the developer to the developing region. The photoreceptor 10 corresponds to an example of the image carrier for carrying an electrostatic image on its surface. The suction tube 18 corresponds to an example of the suction passage for sucking air.

A flow of the image formation executed in the printer 1 shown in FIG. 1 will be briefly explained below.

In the printer 1, a surface of the photoreceptor 10 rotated in the direction of the arrow A is given an electric charge by the charging unit 11. When the surface of the photoreceptor 10, which has been given the electric charge, is irradiated with exposure light by the exposure unit 12 according to an electrostatic latent image sent from the outside, the electrostatic latent image is formed on the surface of the photoreceptor 10. The developing roller 20 of the developing unit 13 transports developer to the developing region P opposed to the photoreceptor 10. The electrostatic latent image formed on the photoreceptor 10 is developed by the electrically charged toner contained in the developer. A developed toner image is transferred onto a sheet of recording paper, which has been transported in the direction of the arrow B, by the transfer unit 14. After that, the toner image on the sheet of recording paper is melted and fixed onto the sheet of recording paper by the fixing unit 15.

A portion of the developer, which has been transported to the developing region P by the developing roller 20, collides with the photoreceptor 10 and rises up and floats in the air. The developer floating in the air is referred to as floating toner hereinafter. The floating toner is sucked from the suction port 18*a* of the suction tube 18 by the action of the pump 182. The thus sucked toner is filtered by the filter 181. As described later, the developing roller 20 is provided with grooves. Therefore, the suction tube 18 sucks the floating toner from both the upstream side region R and the downstream side region Q in the developing region P.

Successively, the developing roller 20 of the developing unit 13 will be explained below.

Figure 3:
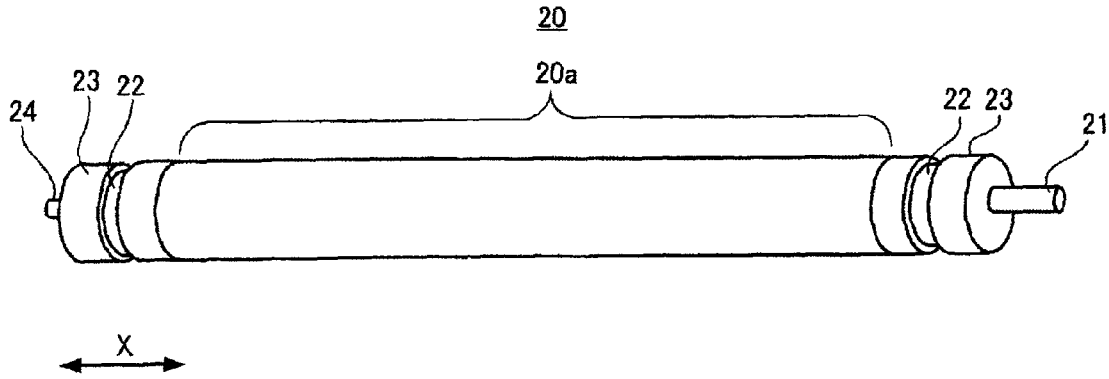
FIG. 3 is a view showing a developing roller of the developing unit shown in FIG. 1.

FIG. 3 is a perspective view showing a structure of the developing roller of the developing unit.

The developing roller 20 is a cylindrical member. Inside the developing roller 20, a permanent magnet roller not shown is arranged. This permanent magnet roller is fixed to a housing of the printer through the fixing shaft 24. The developing roller 20 is rotated along a circumferential surface of the permanent magnet roller. The permanent magnet roller is composed in such a manner that plural of magnetic poles are arranged in the circumferential direction of the developing roller 20. The permanent magnet roller has a magnetic force distribution to regulate the attraction and release of the developer. Since the permanent magnet roller is widely known, it will not be explained anymore here.

The developing roller 20 has a rotary shaft 21 provided at an end of the developing roller 20 on the opposite side to the rotary shaft 24. When the rotary shaft 21 is rotated by the gear train 133, the developing roller 20 is rotated integrally with the rotary shaft 21. The developing roller 20 is rotated round a central axis connecting the rotary shaft 21 with the stationary shaft 24. A direction in which the rotary central axis is extended, that is, a direction in which the cylindrical developing roller 20 is extended is referred to as the axial direction X.

On the circumferential surface of the developing roller 20, a pair of grooves 22, which are extended in the circumferential direction, are provided. To explain in more detail, the central portion in the axial direction X of the developing roller 20 is a carrying region 20*a* for carrying and transporting the developer. One groove 22 is provided on one outside in the axial direction X of the carrying region 20*a* and the other groove is provided on the other outside in the axial direction X of the carrying region 20*a*. One groove 22 in the two grooves, that is, the groove on the right side in FIG. 3 is arranged on the side in the axial direction X on which the feeder member 132 and the gear train 133 (shown in FIG. 2) are arranged. The grooves 22 are formed by shaving the circumferential surface of the developing roller 20.

Figure 4:
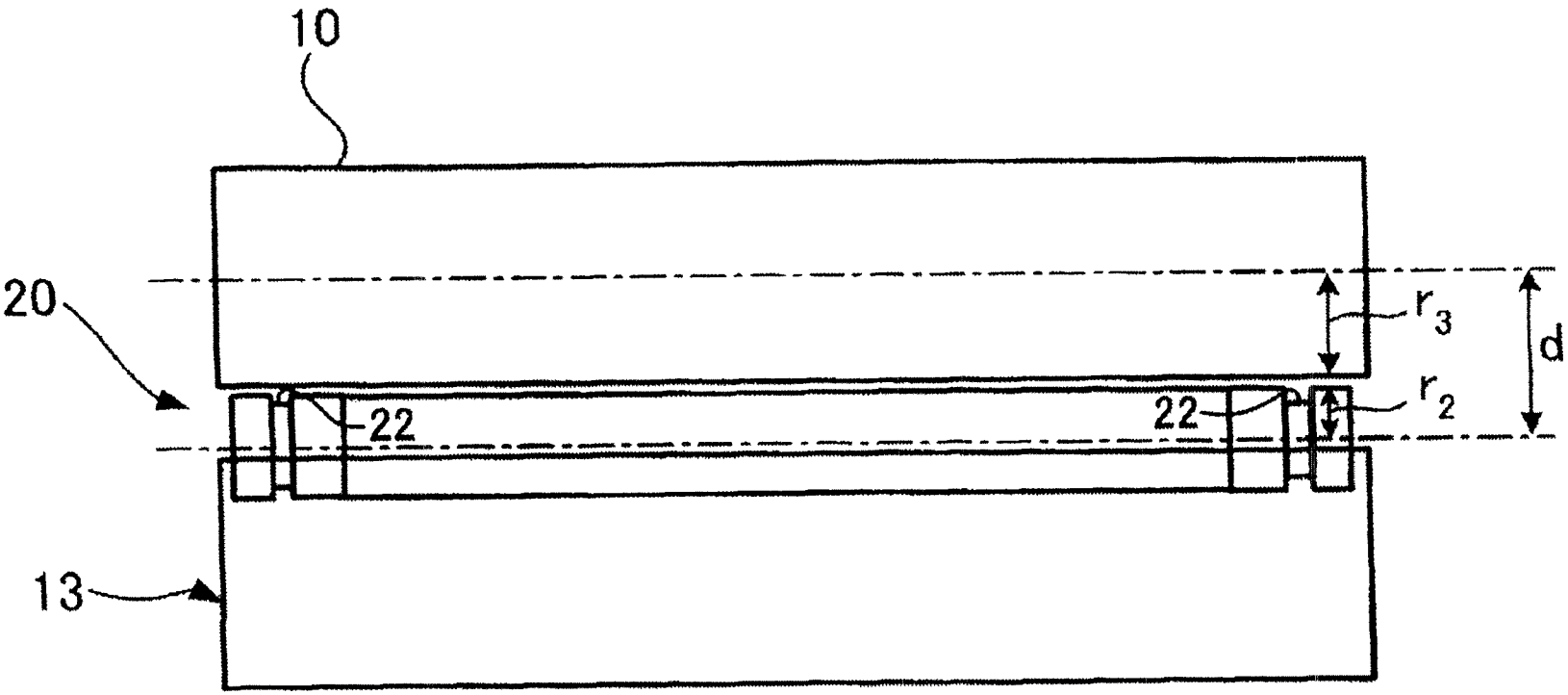
FIG. 4 is a plan view showing an arrangement of the photoreceptor and the developing roller shown in FIG. 1.
Figure 5:
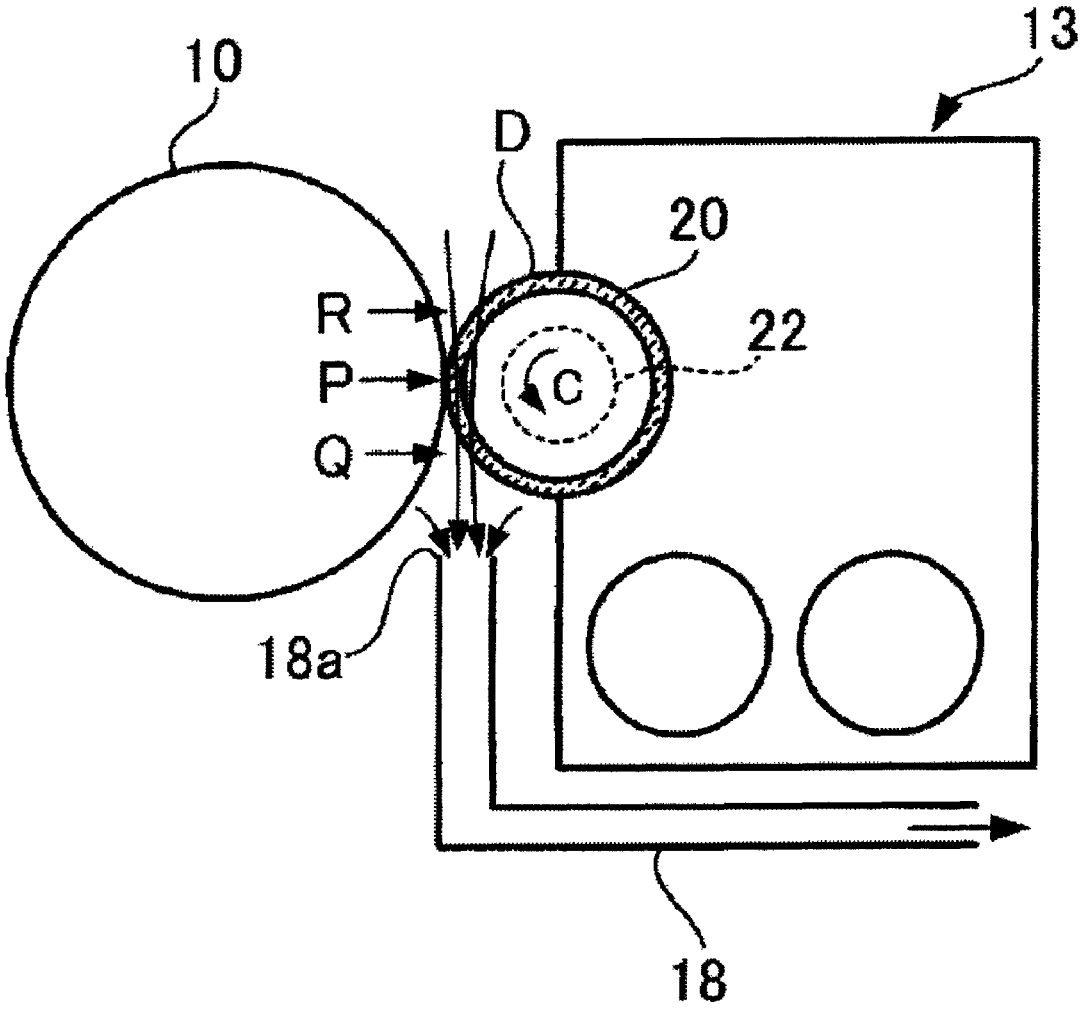
FIG. 5 is a sectional view showing an arrangement of the photoreceptor and the developing roller shown in FIG. 1.

FIG. 4 is a plan view showing an arrangement of the photoreceptor and the developing roller shown in FIG. 1. FIG. 5 is a sectional view. In this connection, in FIG. 5, the developer is shown which is carried in the suction tube 18 and on the circumferential surface of the developing roller 20.

The photoreceptor 10 and the developing roller 20 are respectively arranged at positions at which no forces are given to the end portion 23 of the developing roller 20 from the photoreceptor 10. To explain in more detail, the edge portions 23 of the developing roller 20 does not come into contact with the photoreceptor 10. That is, the radius r2 of the end portion 23 of the developing roller 20 is smaller than a distance obtained when the radius r3 of the photoreceptor 10 is subtracted from the distance d between the rotary shaft of the developing roller 20 and the rotary shaft of the photoreceptor 10. In the present exemplary embodiment, the developing roller 20 is not contacted with the photoreceptor 10 even in the carrying region 20*a*. Therefore, an interval is formed between the developing roller 20 and the photoreceptor 10 in the developing region P. To the developing region P, the developer D is supplied as shown in FIG. 5. One portion of the toner contained in the developer D adheres onto the photoreceptor 10 and forms a toner image. Another portion of the toner contained in the developer D returns into the developing unit 13 while adhering onto the developing roller 20, however, the remaining portion of toner becomes floating toner.

The suction tube 18 sucks the floating toner generated in both the region R on the upstream side and the region Q on the downstream side of the developing region P. The suction port 18*a* of the suction tube 18 is arranged in the region Q on the downstream side of the rotation of the developing roller 20. Therefore, the floating toner in the region Q on the downstream side is directly sucked from the suction port 18. The floating toner in the region R on the upstream side passes in the groove 22 provided in the developing roller 20 and is sucked from the suction port 18. Therefore, the floating toner suction efficiency of sucking the floating toner generated in the region R on the upstream side is enhanced. The floating toner in the region R on the upstream side does not pass in the region, in which the devices of the outside of the developing unit 13 such as a feeder member 132 and a gear train 133 (shown in FIG. 2) are arranged, but passes in the groove 22 provided in the developing roller 20. Accordingly, the devices arranged outside the developing unit 13 can be prevented from being polluted by the floating toner. Since the floating toner passes in the groove 22 formed on the side in the axial direction X on which the feeder member 132 and the gear train 133 (shown in FIG. 2) are arranged, the floating toner can be prevented from entering the feeder member 132 and the gear train 133 arranged outside of the groove 22.

Concerning the developing roller 20 in the present exemplary embodiment, the circumferential surface is rotated from the developing region P toward the suction port 18*a*. Therefore, in the groove 22 of the developing roller 20, a laminar flow directed from the upstream to the downstream of the rotation is generated in the groove 22 of the developing roller 20. Therefore, the suction of sucking the floating toner from the region R on the upstream side can be facilitated by the laminar flow directed toward the suction port 18*a*.

Second Exemplary Embodiment

Successively, the second exemplary embodiment of the present invention will be explained below. The second exemplary embodiment described below is different from the first exemplary embodiment at the following point. In the second exemplary embodiment, the developing roller 20 includes: a member for carrying the developer; and a member in which a groove is formed. Other points of the second exemplary embodiment are the same as those of the first exemplary embodiment. Therefore, like reference marks are used to indicate like components in the first and the second exemplary embodiment and only the different points of the second exemplary embodiment from the first exemplary embodiment will be explained below.

Figure 6:
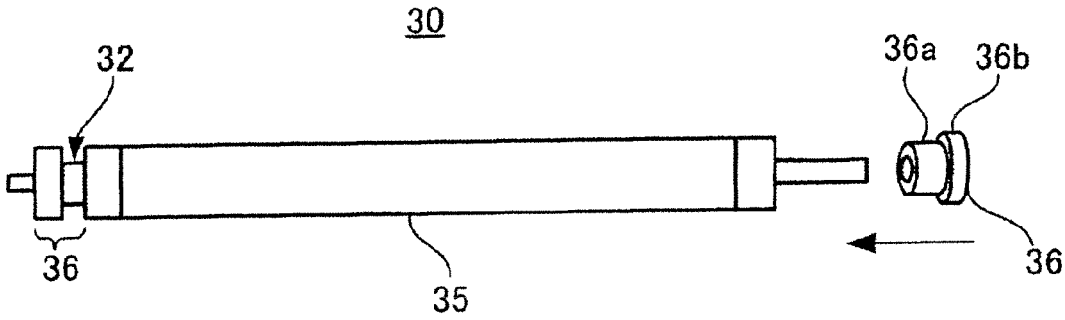
FIG. 6 is a view showing a developing roller in the second exemplary embodiment.

FIG. 6 is a view showing a developing roller in the second exemplary embodiment.

The developing roller 30 shown in FIG. 6 includes: a first member 35 for carrying the developer; and a pair of the second members which are arranged being adjacent to the first member 35 in the axial direction of the rotation. FIG. 6 shows a state in which one of the pair of the second members 36 has already been attached to the first member 35 and the other of the pair of the second members 36 has not been attached to the first member 35 yet.

Each of the second members 36 includes: a relatively small cylindrical small diameter portion 36*a*; and a relatively large cylindrical large diameter portion 36*b*. A diameter of the large diameter portion 36*b* of the second member 36 is not more than a diameter of the first member 35. When each of the second members 36 is attached to the first member 35, the small diameter portion 36*a* forms a bottom of the groove 32 and the large diameter portion 36*b* forms one of both the side walls of the groove. The other side wall is formed out of the end face in the axial direction of the first member 35. That is, in the second member 36, a portion of the groove 32 is formed.

In the case where the developing roller 30 is manufactured, first, the first member 35 is made of material for carrying the developer. On the other hand, the second members 36 are made of material from which the groove can be easily formed. After that, when the second members 36 are attached and fixed to the first member 35, the developing roller 30 having the grooves 32 of a simple structure can be manufactured.

Variation of Second Exemplary Embodiment

In the second exemplary embodiment explained above, the second member 36 includes a small diameter portion 36*a* and a large diameter portion 36*b*. Successively, a variation will be explained in which the second member is formed into another shape.

Figure 7:
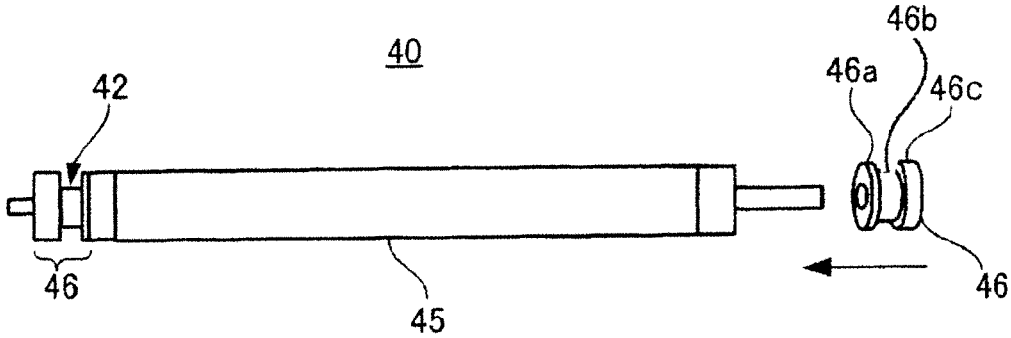
FIG. 7 is a view showing a developing roller in a variation of the second exemplary embodiment.

FIG. 7 is a view showing a developing roller in a variation of the second exemplary embodiment.

In the developing roller 40 shown in FIG. 7, each of the second members 46 includes: two large diameter portions 46*a*, 46*c*; and a small diameter portion 46*b* interposed between the large diameter portions 46*a*, 46*c*. In this developing roller 40, the entire groove 42 is provided in the second member 46.

Third Exemplary Embodiment

Successively, the third exemplary embodiment of the present invention will be explained below. The third exemplary embodiment is different from the exemplary embodiments described above at the following point. The second members of the developing roller of the third exemplary embodiment are rotated independently from the first exemplary embodiment. Other points of the third exemplary embodiment are the same as those of the exemplary embodiments described above. Therefore, like reference marks are used to indicate like components in the exemplary embodiments described before and the third exemplary embodiment and only different points of the third exemplary embodiment from the exemplary embodiments described before are explained below.

The developing roller of the present exemplary embodiment is different from the developing roller 40 shown in FIG. 7 only at the following point. The second members of the developing roller of the present exemplary embodiment are not fixed to the first member. Therefore, the second members are rotated independently from the first member. Therefore, FIG. 7 is used as it is for the following explanations.

Figure 8:
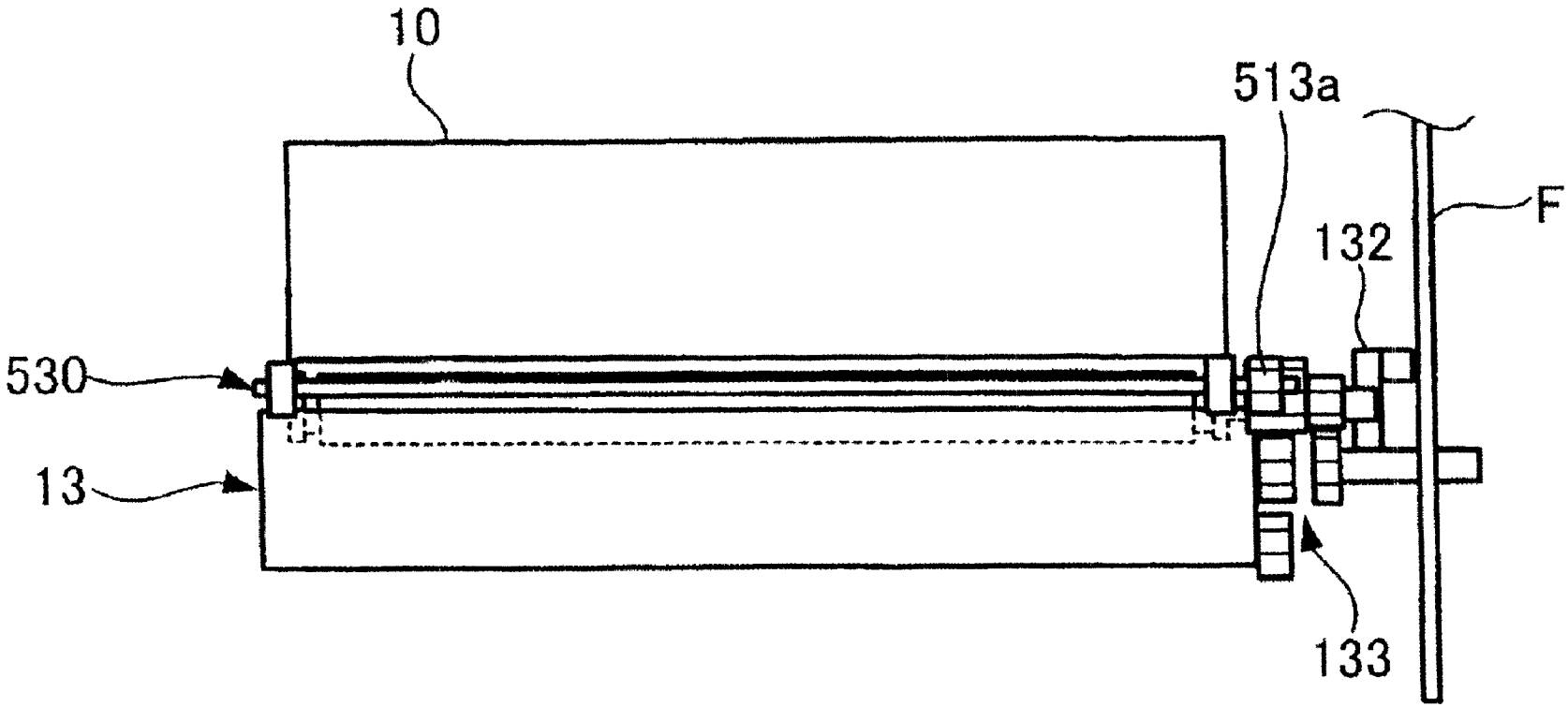
FIG. 8 is a plan view showing an arrangement of the photoreceptor and the developing unit of the printer of the third exemplary embodiment.

FIG. 8 is a plan view showing an arrangement of the photoreceptor and the developing unit in the printer of the third exemplary embodiment.

The printer shown in FIG. 8 is different from that of the first exemplary embodiment shown in FIG. 2 at the following points. With respect to the gear train 133, the printer shown in FIG. 8 includes an inversion driving portion 530 having an inversion gear 513*a* for rotating the second members of the developing roller in the opposite direction to the rotating direction of the first member. The first member (reference numeral 45 in FIG. 7) of the developing roller is rotated in the opposite direction to that of the developing roller of the first exemplary embodiment.

Using FIG. 5 as it is, the suction of the floating toner in the third exemplary embodiment will be explained below.

In the developing roller of the third exemplary embodiment, the first member (reference mark 45 shown in FIG. 7) for transporting toner is rotated in the opposite direction to the arrow C in FIG. 5 and the second member in which the groove is formed is rotated in the direction of the arrow C. In the printer of the third exemplary embodiment, irrespective of the rotary direction of the first member for transporting the developer, a laminar flow directed to the suction port 18*a* is generated in the groove by the second member which is rotated so that the circumferential surface can be directed to the suction port 18*a*. By this laminar flow, the suction of the floating toner from the suction port 18*a* can be facilitated.

Fourth Exemplary Embodiment

Successively, the fourth exemplary embodiment of the present invention will be explained below. The following fourth exemplary embodiment is different from the first exemplary embodiment at the following point. In the fourth exemplary embodiment, two developing rollers are provided. Other points of the fourth exemplary embodiment are the same as those of the first exemplary embodiment. Accordingly, in the explanations of the fourth exemplary embodiment, like reference marks are used to indicate like components in the first and the fourth exemplary embodiment and only the different points of the fourth exemplary embodiment from the exemplary embodiment described before will be explained below.

Figure 9:
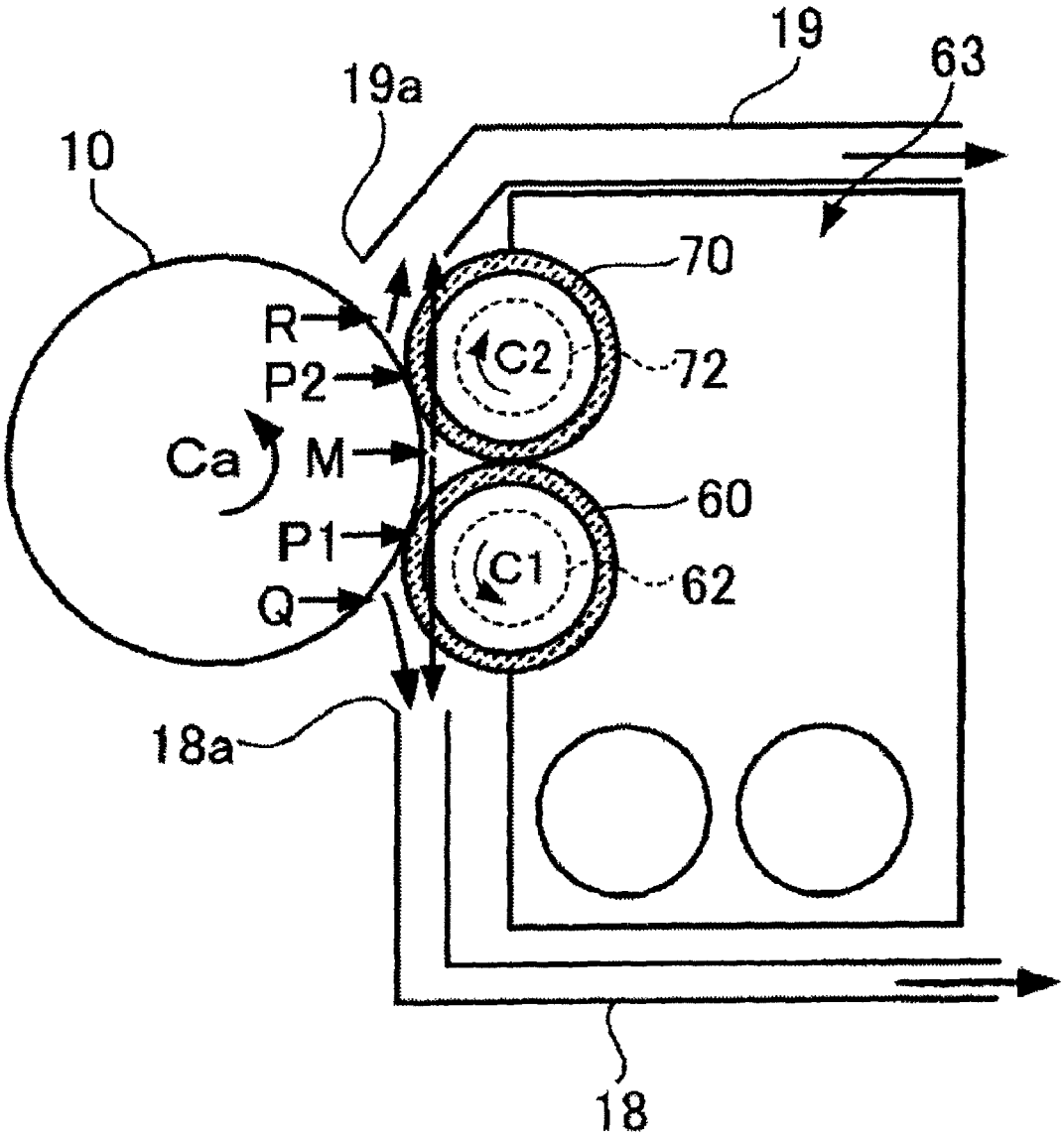
FIG. 9 is a sectional view showing an arrangement of the photoreceptor and the developing roller in the printer of the fourth exemplary embodiment.

FIG. 9 is a sectional view showing an arrangement of the photoreceptor and the developing roller in the printer of the fourth exemplary embodiment.

In the printer of the fourth exemplary embodiment, the developing unit 63 includes a pair of developing rollers 60, 70. The pair of developing rollers 60, 70 are arranged being adjacent to each other and the respective circumferential surfaces of the developing rollers 60, 70 are opposed to the photoreceptor 10 in the respective developing regions P1 and P2. The first developing roller 60, which is one of the pair of developing rollers 60, 70, is arranged on the upstream side in the rotary direction Ca of the photoreceptor 10 with respect to the other second developing roller 70. The respective shapes of the developing rollers 60, 70 are the same as the shape of the developing roller 20 explained before referring to FIG. 3. In this case, the first developing roller 60 corresponds to an example of the first developer transporting member of the present invention and the second developing roller 70 corresponds to an example of the second developer transporting member of the present invention.

The printer of the fourth exemplary embodiment includes another suction tube 19 in addition to the suction tube 18. However, two suction tubes 18, 19 are joined to each other in the middle and connected to the pump 182 through the filter 181 (shown in FIG. 1). The suction ports 18*a*, 19*a* of the suction tubes 18, 19 are respectively arranged in two regions R, Q except for the region M between a pair of developing regions P1, P2 in three regions R, M, Q which are divided with respect to a pair of developing regions P1, P2 in the pair of developing rollers 60, 70. To explain in more detail, one suction port 18*a* is arranged in the region Q on the upstream side in the rotary direction Ca of the rotation of the photoreceptor 10 of the developing region P1 of the first developing roller 60. The other suction port 19*a* is arranged in the region Q on the downstream side in the rotary direction Ca of the rotation of the photoreceptor 10 of the developing region P2 of the second developing roller 70. The developing rollers 60, 70 are respectively rotated in the rotary directions so that the moving directions of the circumferential surfaces of the developing rollers 60, 70 at positions opposed to each other can be the same. That is, the developing rollers 60, 70 are rotated in the opposite direction to each other. To explain in more detail, the first developing roller 60 is rotated in the direction C1 in which a circumferential surface of the first developing roller 60 can be directed from the developing region P1 of the first developing roller 60 to the suction port 18*a* and the second developing roller 70 is rotated in the direction C2 in which a circumferential surface of the second developing roller 70 can be directed from the developing region P2 of the second developing roller 70 to the suction port 19*a*.

In the printer of the fourth exemplary embodiment, development is transported out twice by the pair of developing rollers 60, 70. Therefore, an electrostatic latent image formed on the photoreceptor 10 can be more surely developed than a case in which development is transported out once. However, in the region M between the pair of development regions P1, P2, the developer is divided into two developing rollers 60, 70. Accordingly, a quantity of floating toner is increased.

In the printer of the fourth exemplary embodiment, two suction passages for sucking the floating toner generated in the region M between the development regions P1, P2 are provided. The floating toner generated in the region M between the development regions P1, P2 passes in the grooves 62, 72 respectively provided in the pair of developing rollers 60, 70 and is sucked from the suction ports 18*a*, 19*a*. Since the floating toner passes in the grooves 62, 72, compared with a case of the constitution in which no grooves are provided, the suction efficiency of sucking the floating toner is enhanced. In the same manner as that of the printer of the first exemplary embodiment, even in the printer of the fourth exemplary embodiment, the devices such as a feeder member 132 and a gear train 133 (shown in FIG. 2) arranged outside the developing unit 63 can be prevented from being polluted by the floating toner. In the printer of the fourth exemplary embodiment, the first developing roller 60, which is one of the developing rollers, is rotated so that the circumferential surface of the first developing roller 60 can be rotated in the direction C1 directed from the developing region P1 of the first developing roller 60 to the suction port 18*a*. Accordingly, in the groove 62 of the first developing roller 60, a laminar flow directed from the upstream to the downstream of the rotation (from the upper portion to the lower portion in FIG. 9) is generated by the rotation. The second developing roller 70, which is the other of the developing rollers, is rotated so that the circumferential surface of the second developing roller 70 can be rotated in the direction C2 directed from the developing region P2 of the second developing roller 70 to the suction port 19*a*. Accordingly, in the groove 72 of the second developing roller 70, a laminar flow directed from the upstream to the downstream of the rotation (from the lower portion to the upper portion in FIG. 9) is generated by the rotation. Therefore, the floating toner existing in the region M between the developing regions P1 and P2 is made to pass in the grooves 62, 72 being facilitated by the laminar flow.

Example of Measurement

Successively, explanations will be made into an example of the measurement in which a quantity of floating toner flowing outside the developing unit is measured.

With respect to the constitution explained in the fourth exemplary embodiment, a printer is made in which the groove 62 is formed in one of the pair of developing rollers 60, 70 and then printing is executed. In this connection, concerning the dimensions of the groove 62 formed in the first developing roller 60, the depth is 1 mm and the width is 3 mm. Concentration of the toner contained in the developer is 13% and printing is executed in the white paper mode, that is, printing is executed in a mode in which no toner is transferred onto a sheet of recording paper. Further, as an example for reference, a printer is made in which no grooves was formed in any of the pair of developing rollers and then printing is executed in the same condition. A quantity of the floating toner flowing outside the developing unit is measured as follows. A suction port of the powder detecting device is arranged in an end portion in the axial direction of the rotary shaft of the region M between a pair of developing regions P1 and P2 shown in FIG. 9. A quantity of powder sucked from the suction port is measured in the air.

Figure 10:
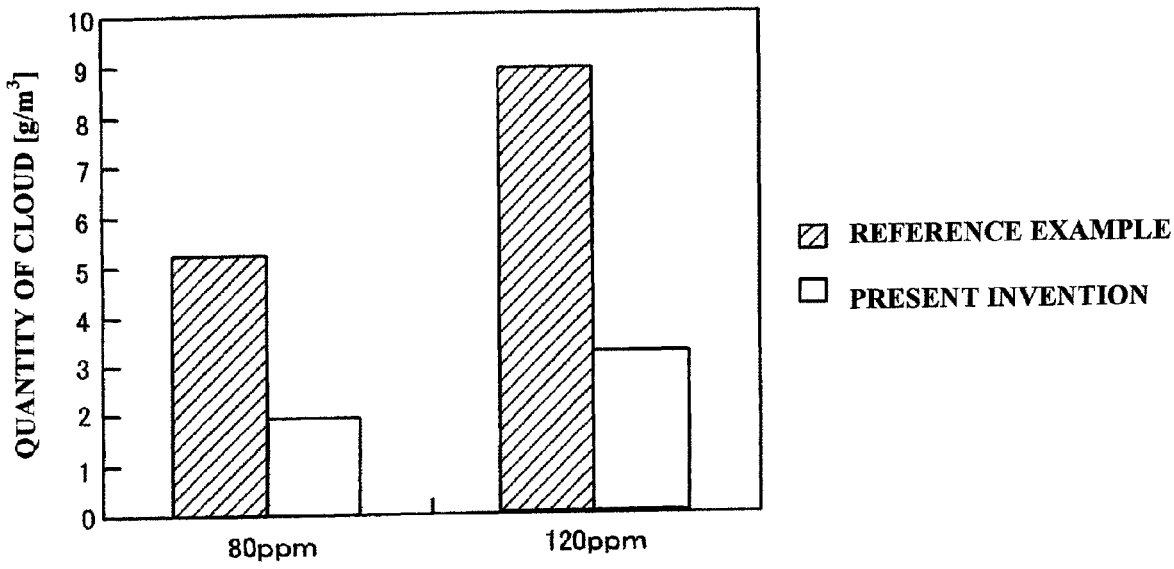
FIG. 10 is a graph showing a result of the measurement in which a quantity of the floating toner flowing outside the developing unit of the printer is measured.

FIG. 10 is a graph showing a result of the measurement in which a quantity of the floating toner flowing outside the developing unit of the printer is measured.

The graph of FIG. 10 shows a result of the measurement in which a quantity of the floating toner is measured in both cases of low speed printing of 80 sheets per minute and high speed printing of 120 sheets per minute.

At the time of low speed printing in which the printing speed is 80 sheets per minute, in the reference example in which no developing grooves was provided, a quantity of cloud, that is, a quantity of floating toner exceeded 5 g/m$^3$. On the other hand, in the case of a printer in which grooves was formed in the developing roller, a quantity of floating toner is smaller than 2 g/m$^3$. At the time of high speed printing in which the printing speed is 120 sheets per minute, in the reference example in which no developing rollers was provided, a quantity of cloud, that is, a quantity of floating toner exceeded 8 g/m$^3$. On the other hand, in the case of a printer in which grooves was provided in the developing roller, a quantity of floating toner is smaller than 4 g/m$^3$. That is, the following is confirmed. In the printer in which the grooves was provided in the developing roller, the quantity of floating toner flowing outside the developing unit is reduced at least by half.

In this connection, in the exemplary embodiment described above, the image forming apparatus of the present invention is a printer for forming a monochromatic image. However, it should be noted that the present invention is not limited to the above specific exemplary embodiment. For example, the present invention may be applied to a color printer in which an image is formed for each color. Further, the present invention may be applied to a copier or a facsimile terminal device.

The exemplary embodiments described above may be combined with each other. For example, in the fourth exemplary embodiment in which a pair of developing rollers are provided, the developing roller may include the first and the second member as explained in the second exemplary embodiment. Further, as explained in the third exemplary embodiment, the second member can be rotated independently from the first member.

In the exemplary embodiments described above, the developer transporting member of the present invention is a developing roller in which grooves are provided on both end sides. However, it should be noted that the present invention is not limited to the above specific exemplary embodiments. For example, the groove may be provided only on one side. The developer transporting member of the present invention is a developing roller in which one groove is provided on each end side of both end sides. However, it should be noted that the present invention is not limited to the above specific exemplary embodiment. For example, plural of grooves may be provided on both end sides or only on one end side. Further, the groove may be formed into a spiral shape, the length of which is not less than one circumference of the developing roller.

In the exemplary embodiments described above, the developer transporting member of the present invention is a substantially cylindrical developing roller rotating outside a permanent magnet roller. However, it should be noted that the developer transporting member of the present invention is not limited to the above specific exemplary embodiment. As long as the developer transporting member has a cylindrical circumferential surface, any member can be used for the developer transporting member, for example, a columnar member can be used.

In the exemplary embodiment described above, concerning the developer transporting member in which the groove of the present invention is formed or concerning the first member in which the groove of the present invention is formed, the developer transporting member or the first member is rotated so that a circumferential surface of at least a portion in which the groove is formed can be directed to the suction port. However, it should be noted that the present invention is not limited to the above specific exemplary embodiment. For example, the developer transporting member or the first member may be rotated in the opposite direction. However, when the developer transporting member or the first member is rotated so that at least the portion in which the groove is formed can be directed to the suction port, the suction of the floating toner can be facilitated by a laminar flow.

In the exemplary embodiment described above, concerning the suction passage of the present invention, the suction tube is provided in such a manner that the suction port is arranged on the downstream side of the developing region in the rotary direction of the photoreceptor. However, it should be noted that the present invention is not limited to the above specific exemplary embodiment. For example, the suction port may be arranged in the upstream of the developing region in the rotary direction of the photoreceptor.

In the exemplary embodiment described above, the suction passage of the present invention is a suction tube having a suction port. However, it should be noted that the suction passage of the present invention is not limited to the above specific exemplary embodiment. For example, the suction passage may be formed into a box-shape in which the suction port is formed in a portion of the wall.

In the exemplary embodiments described above, the developing device of the present invention is a developing unit in which developing is executed by developer containing toner and magnetic carrier. However, it should be noted that the suction passage of the present invention is not limited to the above specific exemplary embodiments. For example, development may be executed by one component type developer that does not contain carrier.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments was chosen and described in order to best explain the principles of the invention and its practical applications, thereby enabling others skilled in the art to understand the invention for various exemplary embodiments and with the various modifications as are suited to the particular use contemplated. It is intended that the scope of the invention be defined by the following claims and their equivalents.

What is claimed is:

1. A developing device comprising:

a developer transporting member that is arranged so that a circumferential surface of the developer transporting member is opposed to an image carrier for carrying an electrostatic image on a surface thereof, the developer transporting member being rotated in a circumferential direction while carrying a developer on the circumferential surface thereof to transport the developer to a developing region in which the surface of the image carrier and the circumferential surface of the developer transporting member are opposed to each other, and having a groove extending in the circumferential direction on the circumferential surface of the developer transporting member outside in an axial direction of a developer carrying region for carrying the developer; and a suction port being arranged at least at one of an upstream side region and a downstream side region of the developer transporting member, wherein the upstream side region is located adjacent to and upstream of the developing region in the rotating direction of the developer transporting member, and the downstream side region is located adjacent to and downstream of the developing region in the rotating direction of the developer transporting member, wherein the developer transporting member includes a first developer transporting member and a second developer transporting member that are arranged adjacent to each other, and a circumferential surface of each developer transporting member is opposed to the image carrier in each developing region, the image carrier is rotated in a circumferential direction of a circumferential surface thereof, the first developer transporting member is arranged on an upstream side in a rotation direction of the image carrier with respect to the second developer transporting member, and the suction port is arranged upstream of the developing region of the first developer transporting member in the rotation direction of the image carrier and another suction port is arranged downstream of the developing region of the second developer transporting member in the rotation direction of the image carrier.

2. The developing device according to claim 1, wherein the developer transporting member is rotated in a direction from the developing region to the suction port.

3. The developing device according to claim 1, wherein the developer transporting member includes the first developer transporting member that carries the developer on the circumferential surface thereof, and the second developer transporting member that includes at least a part of the groove and that is arranged adjacent to the first developer transporting member in an axial direction of the developer transporting member.

4. The developing device according to claim 3, wherein the second developer transporting member is rotated in the direction from the developing region to the suction port independently of the rotation direction of the first developer transporting member.

5. The developing device according to claim 1, wherein the first and second developer transporting members are rotated so that moving directions of the circumferential surfaces of the first and second developer transporting members at a position where the circumferential surfaces of the first and second developer transporting members are opposed to each other are the same direction.

6. The developing device according to claim 1, wherein each of the suction port and the another suction port corresponds to respective one of the first and second developer transporting members.

7. An image forming apparatus comprising:

an image carrier that carries an electrostatic image on a surface thereof;

an image forming portion that forms the electrostatic image on the image carrier;

a developing device that includes:

a developer transporting member that is arranged so that a circumferential surface of the developer transporting member is opposed to the image carrier for carrying an electrostatic image on a surface thereof, the developer transporting member being rotated in a circumferential direction while carrying a developer on the circumferential surface thereof to transport the developer to a developing region in which the surface of the image carrier and the circumferential surface of the developer transporting member are opposed to each other, and having a groove extending in the circumferential direction on the circumferential surface of the developer transporting member outside in an axial direction of a developer carrying region for carrying the developer, and a suction port being arranged at least at one of an upstream side region and a downstream side region of the developer transporting member, wherein the upstream side region is located adjacent to and upstream of the developing region in the rotating direction of the developer transporting member, and the downstream side region is located adjacent to and downstream of the developing region in the rotating direction of the developer transporting member; and a suction tube that sucks air near one of the upstream side region and the downstream side region, wherein the developer transporting member includes a first developer transporting member and a second developer transporting member that are arranged adjacent to each other, and a circumferential surface of each developer transporting member is opposed to the image carrier in each developing region, the image carrier is rotated in a circumferential direction of a circumferential surface thereof, the first developer transporting member is arranged on an upstream side in a rotation direction of the image carrier with respect to the second developer transporting member, and the suction port is arranged upstream of the developing region of the first developer transporting member in the rotation direction of the image carrier and another suction port is arranged downstream of the developing region of the second developer transporting member in the rotation direction of the image carrier.

8. The image forming apparatus according to claim 7, further comprising:

a driving mechanism that drives the first and second developer transporting members and that is arranged outside of the first and second developer transporting members in the axial direction of the first and second developer transporting members, wherein the groove is formed at least on a side of the driving mechanism that is one of both sides in the axial direction of the carrying region.

9. The image forming apparatus according to claim 7, wherein each of the suction port and the another suction port corresponds to respective one of the first and second developer transporting members.

* * * * *